US006086478A

United States Patent [19]

Klitsner et al.

[11] Patent Number: 6,086,478

[45] Date of Patent: Jul. 11, 2000

[54] HAND-HELD VOICE GAME

[75] Inventors: Daniel B. Klitsner, Larkspur, Calif.; Robert M. Welch, Marblehead, Mass.

[73] Assignee: Hasbro, Inc., Pawtucket, R.I.

[21] Appl. No.: 08/933,994

[22] Filed: Sep. 19, 1997

[51] Int. Cl.[7] ..... A63F 13/00; A63F 9/24; G06F 17/00; G06F 19/00

[52] U.S. Cl. ..... 463/35; 463/7; 463/37; 463/46; 273/273; 273/440; 273/445; 273/446; 273/460

[58] Field of Search ..... 463/1, 2, 3, 4, 463/5, 6, 7, 8, 30, 35, 36, 37, 46; 345/3, 5; 273/237, 273, 460, 454, 455, 440, 445; 434/258, 247

[56] References Cited

U.S. PATENT DOCUMENTS

| | | | |
|---|---|---|---|
| 3,748,748 | 7/1973 | Bevan et al. | 35/8 A X |
| 3,851,875 | 12/1974 | Breslow et al. | 273/1 E X |
| 3,982,764 | 9/1976 | Dieball | 23/135 A X |
| 4,095,785 | 6/1978 | Conner | 273/1 E X |
| 4,298,198 | 11/1981 | Huang et al. | 273/1 GC X |
| 4,326,710 | 4/1982 | Breslow et al. | 273/1 E X |
| 4,363,482 | 12/1982 | Goldfarb | 273/1 GC X |
| 4,957,291 | 9/1990 | Miffitt et al. | 273/153 R X |
| 5,405,153 | 4/1995 | Hauck | 273/460 X |
| 5,685,776 | 11/1997 | Stambolic et al. | 463/46 X |

*Primary Examiner*—Jessica J. Harrison
*Assistant Examiner*—Binh-An Nguyen
*Attorney, Agent, or Firm*—Morgan & Finnegan, LLP

[57] ABSTRACT

A hand-held game that includes a plurality of input devices, an audible output device, and a controller coupled to each of the input devices and to the audible output device. Preferably, each of the input devices require a different mechanical action for action, such as a pressure switch, a pull switch or a rotational switch. The controller outputs a first command signal to the audible output device that relates to a first selected input device. The controller then outputs a second command signal to the audible output device relating to a second selected input device when the first selected input device is actuated within a predetermined period of time. When the first selected input device is not actuated within the predetermined period of time, or when an input device other than the selected input device is actuated in response to the first command signal, the controller outputs an error command signal to the audible output device. The controller then ceases to output command signals to the audible output device after outputting the error command signal. According to the invention, the second command can relate to a second selected input device or can be an audible indication, such as a voice message, for a user to pass the game apparatus to another user.

23 Claims, 2 Drawing Sheets

HAND-HELD VOICE GAME

BACKGROUND OF THE INVENTION

1. Field of the Invention

The present invention relates to the field of games. More particularly, the present invention relates to an apparatus and a method for a hand-held voice game of elimination played by a single player or by multiple players.

2. Description of the Related Art

Apparatuses are known for playing a game that generates voice instructions or sound prompts by the game apparatus. A player listens to a voice or sound prompt produced by the game apparatus and performs a predetermined operation in accordance with the voice or sound prompt.

For example, U.S. Pat. No. 4,770,416 to Shimizu et al. discloses a vocal game device in which players record voice commands corresponding to selected operations that are to be performed by the players. The Shimizu et al. device includes four input switches that are each a different color and contain a lamp for lighting. Players respond to the voice commands generated by the device and the lighting of the lamps during the course of play.

Another device, disclosed by U.S. Pat. No. 5,271,627 to Russell et al., provides audible sounds indicating particular targets that are active for a player to strike. The targets are spatially located around a player and when a target becomes active, a sound prompt is generated and the target is lighted so that the player can quickly identify and strike the active target.

While both of the devices provide sound prompts for instructing a player to perform a specified action, the player does not need to decide between actions of a different nature during the course of play. For the Shimizu et al. device, a player presses a specific key or sequence of keys. For the Russell et al. device, a player strikes an active target. Neither game device requires a player to select between different operations depending upon the sound prompt. Consequently, what is needed is a game that requires a player to select between different operations depending on the sound prompt generated by the game.

SUMMARY OF THE INVENTION

The present invention provides a game that requires a player to select between different operations depending on the sound prompt generated by the game. In that regard, the present invention provides a hand-held game that includes a plurality of input devices, an audible output device, and a controller coupled to each of the input devices and to the audible output device. Preferably, each of the input devices require a different mechanical action for action, such as a pressure switch, a pull switch or a rotational switch. The controller outputs a first command signal to the audible output device that relates to a first selected input device. The controller then outputs a second command signal to the audible output device relating to a second selected input device when the first selected input device is actuated within a predetermined period of time. When the first selected input device is not actuated within the predetermined period of time, or when an input device other than the selected input: device is actuated in response to the first command signal, the controller outputs an error command signal to the audible output device. The controller then ceases to output command signals to the audible output device after outputting the error command signal. According to the invention, the second command can relate to a second selected input device or can be an audible indication, such as a voice message, for a user to pass the game apparatus to another user.

Preferably, the audible output device outputs a different voice message corresponding to each respective command signal. For example, the voice message corresponding to a command signal relating to the pressure switch instructs a user to press the pressure switch. Similarly, the voice message corresponding to a command signal relating to the pull switch instructs the user to pull the pull switch, and the voice message corresponding to a command signal relating to the rotational switch instructs the user to rotate the rotational switch.

The audible output device also can output a different musical sound or prompt corresponding to each respective command signal. For example, the musical sound corresponding to a command signal relating to the pressure switch indicates for a user to press the pressure switch, while the musical sound corresponding to a command signal relating to the pull switch indicates for the user to pull the pull switch, and the musical sound corresponding to a command signal relating to the rotational switch indicates for the user to rotate the rotational switch.

BRIEF DESCRIPTION OF THE DRAWING

The present invention is illustrated by way of example and not limitation in the accompanying figures in which like reference numerals indicate similar elements and in which.

DETAILED DESCRIPTION

Figure 1A:
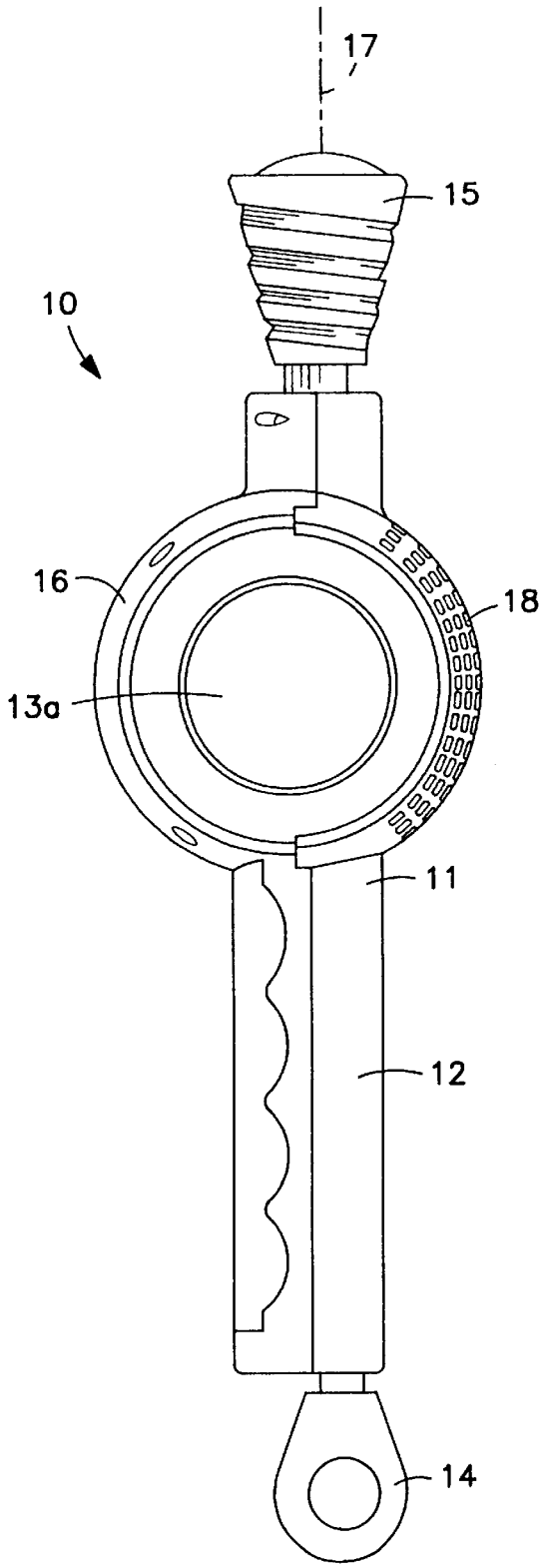
FIGS. 1A and 1B respectively show a front and a side view of a preferred embodiment of the present invention.
Figure 1B:
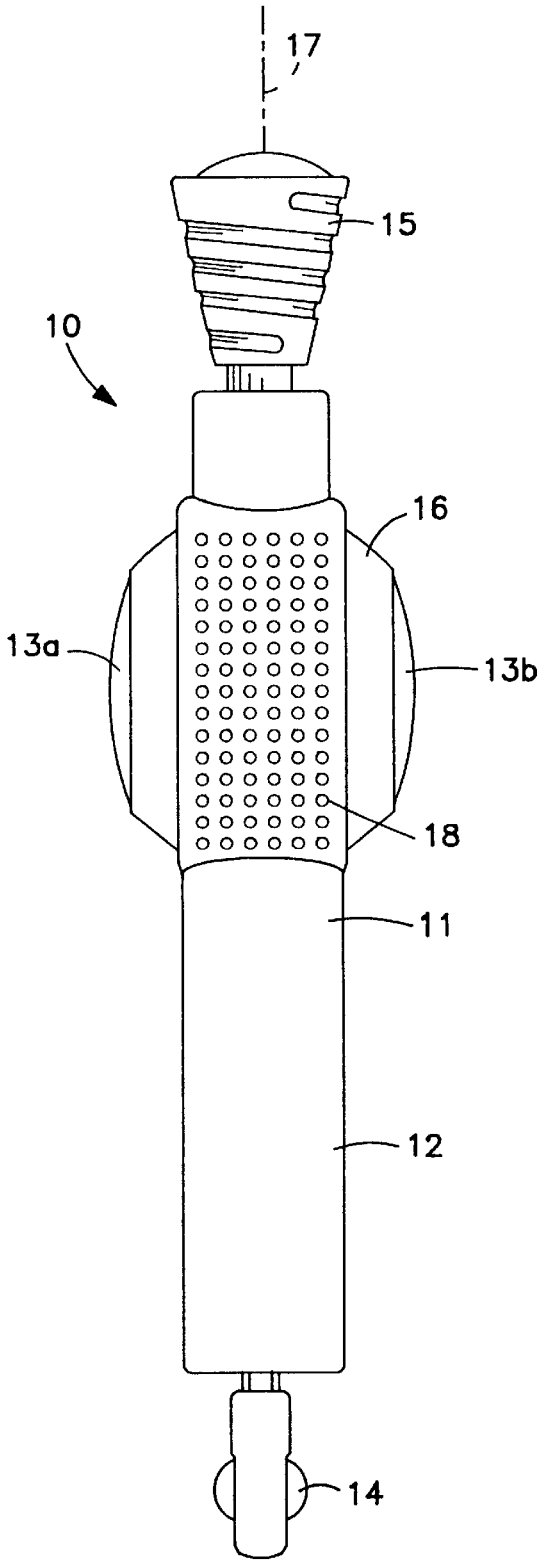

FIGS. 1A and 1B respectively show a front and a side view of a preferred embodiment of the hand-held game 10 of elimination according to the present invention. According to the invention, the game provides audible signals instructing a player to actuate a particular input device, such as a pressure switch, a pull switch or a rotational switch. If the particular input device is not actuated within a predetermined period of time, such as a second, the game outputs an audible error signal, stopping play and indicating that the player who failed to actuate the input device is eliminated from that round of play. The audible signals instructing a player to actuate an input device can be selected to be either voice messages or musical sounds, or prompts, corresponding to each input device.

In FIGS. 1A and 1B, game 10 has a housing 11 that is formed for providing a convenient gripping portion end 12 for holding game 10 in by hand. Three different types of actuation devices are accessible at different locations on game 10. Two pressure switches 13*a* and 13*b*, referred to herein as a bop it buttons, are located at each end of a cylindrical portion 16 of housing 11 so that a player may actuate a bop it button at either of two locations. A pull-switch 14, herein referred to as a pull knob, is located at the gripping portion end 12 of housing 11. Pull knob 14 is actuated by pulling the knob along an axial axis 17 extending along gripping portion 12. rotational switch 15, herein referred to as a twist knob, is located at the end of housing 11 that is opposite gripping portion end 12. Twist knob 15 is actuated by rotating twist knob around axial axis 17. Housing 11 provides an area of openings 18 so that sound produced by an audible output device, such as a speaker, can be heard (luring the course of play.

Figure 2:
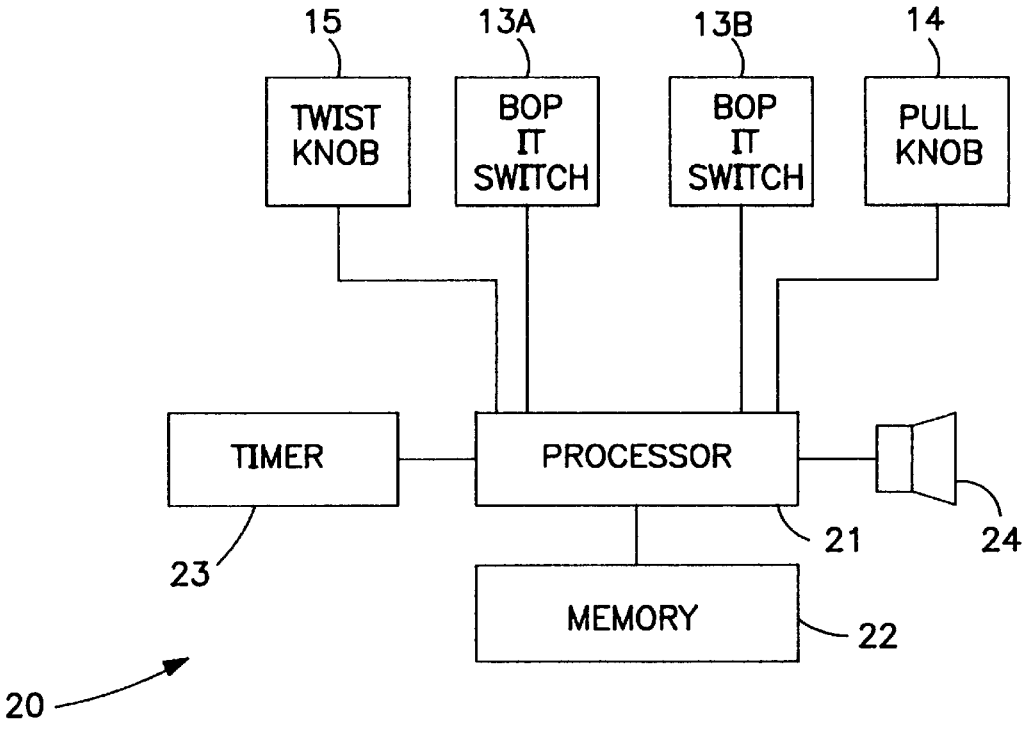
FIG. 2 shows a schematic block diagram of the present invention.

FIG. 2 shows a schematic block diagram 20 of the present invention. A processor or controller 21 is connected to a memory 22, a timer 23, an output device 24, bob it buttons 13*a* and 13*b,* pull knob 14 and twist knob 15. Memory 22 stores instructions that are executable by processor 21 for providing the three different game format described below. Memory 22 also stores data relating to voice instructions and relating to musical sounds or prompts that are generated during the course of play. Timer 23 is used for measuring a predetermined period of time, such as a second, in which a selected input device must be actuated for game play to progress and for generating a game tempo that increases randomly as game play progresses. Processor 21, memory 22 and timer 23 are readily available integrated circuits that have operational capabilities that are suitable for providing the functions of the present invention. Additionally, the functions of the present invention can be performed by an application specific integrated circuit (ASIC), by dedicated logic circuits or by a state machine.

Output device 24, such as a speaker, receives command signals generated by processor 21 during the course of play and generates audible voice instructions or musical prompts. Alternatively, if processor 21 does not have the capability to drive speaker 24 directly, an output conditioning device can be used for conditioning the command signals in a well-known manner for driving speaker 24.

Processor 21 receives actuation signals generated by each of bob it buttons 13*a* and 13*b,* pull knob 14 and twist knob 15, and determines whether the actuation signal corresponds to the selected input device a player was instructed to actuate. If a player actuates the correct input device in response to an instruction within the predetermined period of time, processor selects another input device at random and generates corresponding command signals for output to speaker 24. If a player actuates an incorrect input device, or does not actuate the correct input device within the predetermined period of time, as measured by timer 23, processor 21 generates an error command signal for output to speaker 24, such as a scream and/or a drum tag, or other appropriate error sound. Pull knob 14 is used for selecting one of three different game formats for play by pulling the knob an appropriate number of times for each particular game format, and for repeating a players score after a round in one of the game formats. A bop it button is actuated to start a game once a particular game format has been selected, or to start a new round.

The first game format, for 2 or more players, outputs audible voice messages instructing a player to "bop it", "pull it", or "twist it", along with an audible underlying beat. The first player hits a bop button to start play and, after one measure of the underlying beat, must follow the voice instructions generated by the game in tempo with the underlying beat by performing an appropriate operation within a relatively short period of time, such as a second. At the end of a player's turn, indicated by a voice instruction to "pass it", the game is passed to the next player, such is to the player to the left, during a measure of pass it music. Game play continues in this manner until a player makes a mistake by either failing to perform the specified instructions within the set period of time or by performing the instruction incorrectly. When this occurs, the game generates a scream sound, indicating that the current player has been eliminated, and play stops. The remaining players continue play in the same manner until one player remains, who is the winner. The tempo of the game increases randomly as the game progresses.

The second game format, for 2 or more players, is essentially the same as the first format, but rather than providing game play through verbal instructions, the present invention provides instructions in the form of musical sounds, or prompts, to which game players must respond. That is, when the present invention produces, for example, a drumming-type sound, a player must hit a bop it button 13*a* or 13*b*. When a pull sound is produced, such as a sliding scale of tones, a player must pull pull knob 14. Similarly, when a twist sound, such as a ratcheting sound, is produced, a player must twist twist knob 15.

In the second game format, the first player hits a bop button to start play and, after one measure of the underlying beat, must follow the musical prompts generated by the game in tempo with the underlying beat by performing an appropriate operation within a relatively short period of time. At the end of a player's turn, indicated by a musical prompt to pass it, the game is passed to the next player, such is to the player to the left, during a measure of pass it music. Game play continues in this manner until a player makes a mistake by either failing to perform the specified action within the set period of time or by performing the action incorrectly. When this occurs, the game generates a scream sound, indicating that the current player has been eliminated, and play stops. The remaining players continue play in the same manner until one player remains, who is the winner. The tempo of the game randomly increases as the game progresses.

In the third game format, the present invention is adapted for use by a solo game player or for one player at a time. In this format, the present invention provides voice instructions that must be followed by the game player. A player hits a bop button to start play and, after one measure of the underlying beat, must follow the voice instructions generated by the game in tempo with the underlying beat by performing an appropriate operation within a relatively short period of time. Game play continues in this manner until the player makes a mistake by either failing to perform the specified action within the set period of time or by performing the action incorrectly. When the player commits an error during play, an error sound is first produced and then an indication of the player's score is audibly produced, such as by a count of drum beats. The pull knob can be pulled before start of another game to hear the player's score again. The tempo of the game randomly increases as the game progresses.

While the present invention has been described in connection with the illustrated embodiments, it will be appreciated and understood that modifications may be made without departing from the true spirit and scope of the invention.

What is claimed is:

1. A game apparatus, comprising:

a plurality of input devices in which at least two of the input devices require different mechanical actions for actuation;

an audible output device; and a controller coupled to each of the input devices and to the audible output device, the controller outputting a, first command signal to the audible output device, the first command signal relating to a first selected input device, the controller further outputting a second command signal to the audible output device when the first selected input device is actuated within a predetermined period of time, the second command signal relating to a second selected input device, and outputting an error command signal to the audible output device when the first selected input device is not actuated within the predetermined period of time, wherein the controller outputs the error command signal to the audible output device when an input device other than the selected input device is actuated in response to the first command signal.

2. The game apparatus according to claim 1, wherein the controller ceases to output command signals to the audible output device after outputting the error command signal.

3. The game apparatus according to claim 1, wherein the second command signal relates to one of a second selected input device and an audible indication for a user to pass the game apparatus to another user.

4. The game apparatus according to claim 1, wherein the input devices include a pressure switch, a pull switch and a rotational switch.

5. The game apparatus according to claim 4, wherein the audible output device outputs a different voice message corresponding to each respective command signal.

6.The game apparatus according to claim 5, wherein the voice message corresponding to a command signal relating to the pressure switch instructs a user to press the pressure switch, the voice message corresponding to a command signal relating to the pull switch instructs the user to pull the pull switch, and the voice message corresponding to a command signal relating to the rotational switch instructs the user to rotate the rotational switch.

7. The game apparatus according to claim 6, wherein the second command signal corresponds to one of a voice message for actuating the second selected input device and a voice message for a user to pass the game apparatus to another user.

8. The game apparatus according to claim 4, wherein the audible output device outputs a different musical sound corresponding to each respective command signal.

9. The game apparatus according to claim 8, wherein the musical sound corresponding to a command signal relating to the pressure switch instructs a user to press the pressure switch, the musical sound corresponding to a command signal relating to the pull switch instructs the user to pull the pull switch, and the musical sound corresponding to a command signal relating to the rotational switch instructs the user to rotate the rotational switch.

10. The game apparatus according to claim 9, wherein the second command signal corresponds to one of a musical sound for actuating the second selected input device and a musical sound for a user to pass the game apparatus to another user.

11. The game apparatus according to claim 1, wherein the game apparatus is a hand-held game.

12. A method of playing a game, the method comprising the steps of:

outputting a first command signal to an audible output device, the first command signal relating to a first selected input device, the first selected input device being one of a plurality of input devices, at least two of the input devices requiring different mechanical actions for actuation;

outputting a second command signal to the audible output device when the first selected input device is actuated within a predetermined period of time, the second command signal relating to a second input device;

outputting an error command signal to the audible output divice when the first selected input device is not actuated within the predetermine period of time; and outputting the error command signal to the audible output device when an input device other than the selected input device is actuated in response to the first command signal.

13. The method according to claim 12, further comprising the step of ceasing to output command signals to the audible output device after outputting the error command signal.

14. The method according to claim 12, wherein the second command signal relates to one of a second selected input device and an audible indication for a user to pass the game apparatus to another user.

15. The method according to claim 12, wherein the input devices include a pressure switch, a pull switch and a rotational switch.

16. The method according to claim 15, further comprising the step of outputting a different voice message corresponding to each respective command signal.

17. The method according to claim 16, wherein the voice message corresponding to a command signal relating to the pressure switch instructs a user to press the pressure switch, the voice message corresponding to a command signal relating to the pull switch instructs the user to pull the pull switch, and the voice message corresponding to a command signal relating to the rotational switch instructs the user to rotate the rotational switch.

18. The method according to claim 17, wherein the second command signal corresponds to one of a voice message for actuating the second selected input device and a voice message for a user to pass the game apparatus to another user.

19. The method according to claim 15, further comprising the step of outputting a different musical sound corresponding to each respective command signal.

20. The method according to claim 19, wherein the musical sound corresponding to a command signal relating to the pressure switch instructs a user to press the pressure switch, the musical sound corresponding to a command signal relating to the pull switch instructs the user to pull the pull switch, and the musical sound corresponding to a command signal relating to the rotational switch instructs the user to rotate the rotational switch.

21. The method according to claim 20, wherein the second command signal corresponds to one of a musical sound for actuating the second selected input device and a musical sound for a user to pass the game apparatus to another user.

22. A method of playing a game, the method comprising the steps of:

outputting a first command signal to an audible output device, the first command signal relating to a first selected input device, the first selected input device being one of a plurality of input devices, at least two of the input devices requiring different mechanical actions for actuation;

outputting a second command signal to the audible output device when the first selected input device is actuated within a predetermined period of time, the second command signal relating to a second input device;

outputting an error command signal to the audible output device when the first selected input device is not actuated within the predetermined period of time; and ceasing to output command signals to the audible output device after outputting the error command signal.

23. A method of playing a game, the method comprising the steps of:

outputting a first command signal to an audible output device, the first command signal relating to a first selected input device, the first selected input device being one of a plurality of input devices, at least two of the input devices requiring different mechanical actions for actuation;

outputting a second command signal to the audible output device when the first selected input device is actuated within a predetermined period of time, the second command signal relating to a second input device; and outputting a second command signal to the audible output device when the first selected input device is actuate within a predetermined period of time, the second command signal relating to a second input device; and outputting an error command signal to the audible output device when the first selected input device is not actuated within the predetermined period of time, wherein the second command signal relates to one of a second selected input device and an audible indication for a user to pass the game apparatus to another user.

* * * * *